US006802600B2

(12) United States Patent
Park

(10) Patent No.: US 6,802,600 B2
(45) Date of Patent: Oct. 12, 2004

(54) CARRIAGE ALIGNING APPARATUS FOR INK-JET PRINTER AND METHOD THEREOF

(75) Inventor: Ju-hyun Park, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 19 days.

(21) Appl. No.: 10/218,525

(22) Filed: Aug. 15, 2002

(65) Prior Publication Data

US 2003/0112303 A1 Jun. 19, 2003

(30) Foreign Application Priority Data

Dec. 14, 2001 (KR) ..... 2001-79497

(51) Int. Cl.[7] ..... B41J 2/175; B41J 23/00
(52) U.S. Cl. ..... 347/85; 347/37
(58) Field of Search ..... 347/14, 19, 37, 347/8, 23, 38; 460/283, 354, 354.1, 354.3, 55, 56, 59, 355; 400/354, 354.1, 283

(56) References Cited

U.S. PATENT DOCUMENTS

| | | | | |
|---|---|---|---|---|
| 3,960,256 A | | 6/1976 | Bickoff et al. | 197/1 |
| 5,187,497 A | * | 2/1993 | Hirano et al. | 347/8 |
| 5,332,321 A | * | 7/1994 | Beauchamp et al. | 400/354 |
| 5,388,919 A | | 2/1995 | Kimura et al. | 400/55 |
| 5,700,095 A | * | 12/1997 | Sugiyama | 400/55 |
| 5,887,994 A | * | 3/1999 | Nomura et al. | 400/352 |
| 6,022,091 A | * | 2/2000 | Uchikata et al. | 347/8 |
| 6,340,221 B1 | * | 1/2002 | Driggers et al. | 347/37 |

* cited by examiner

*Primary Examiner*—Stephen D. Meier
*Assistant Examiner*—An H. Do
(74) *Attorney, Agent, or Firm*—Staas & Halsey LLP

(57) ABSTRACT

A carriage aligning apparatus in an ink-jet printer having a guide bar and a carriage disposed to slide along the guide bar to be across a paper transferring direction includes a spherical bearing rotatably connected to the carriage, a shaft hole formed eccentrically with respect to a center of an outer circumference of the spherical bearing to receive the guide bar, and a position deciding unit controlling a position of the spherical bearing with respect to the carriage and aligning the carriage with regard to the guide bar.

38 Claims, 5 Drawing Sheets

CARRIAGE ALIGNING APPARATUS FOR INK-JET PRINTER AND METHOD THEREOF

CROSS-REFERENCE TO RELATED APPLICATIONS

This application claims the benefit of Korean Patent Application No. 2001-79497, filed Dec. 14, 2001, in the Korean Industrial Property Office, the disclosure of which is incorporated hereby by reference.

BACKGROUND OF THE INVENTION

1. Field of the Invention

The present invention relates to a carriage aligning apparatus for an ink-jet printer and a method thereof, and more particularly, to a carriage aligning apparatus for and method of aligning a carriage with respect to a paper transferring direction in an ink-jet printer.

2. Description of the Related Art

Generally, an ink-jet printer has a guide bar disposed across a paper transferring direction on a main frame. A carriage is disposed at the guide bar to slide along the guide bar. The carriage has an ink cartridge and an ink nozzle array ejecting ink of the ink cartridge on the transferring paper. The ink nozzle array has a head gap with the transferring paper passing below the ink nozzle array, and is moved with the carriage to a lengthwise direction of the guide bar. In other words, the lengthwise direction is supposed to be perpendicular to the paper transferring direction.

However, as shown in FIG. 1, in the ink-jet printer having the above structure, an image is irregularly printed since a reference center line L of the ink nozzle array 2 moving along the guide bar 1 and the paper transferring direction A of paper 3 are not at the right angles. In other words, the ink should be ejected as the ink nozzle array 2 is moved along the reference center line L in a state that the ink nozzle array 2 is level with a widthwise direction B of the paper perpendicular to the transferring direction A. Yet, since practically various errors are generated between the guide bar 1 and the carriage 5, there exists a problem like the above-mentioned deviation between the reference center line L and the widthwise direction B.

As described above, when the reference center line L and the widthwise direction B are not level with each other, each line of the printed image is not level with each other as well.

SUMMARY OF THE INVENTION

The present invention has been made to overcome the above and other problems of the related art. Accordingly, it is the object of the present invention to provide a carriage aligning apparatus for an ink-jet printer having an improved structure for and a method of adjusting the alignment of printing paper and an ink nozzle array of the carriage.

Additional objects and advantageous of the invention will be set forth in part in the description which follows and, in part, will be obvious from the description, or may be learned by practice of the invention.

The above and other objects may be achieved by providing carriage aligning apparatus for the ink-jet printer according to an embodiment of the present invention. The carriage aligning apparatus includes a spherical bearing rotatably connected to a carriage moving along the guide bar, a shaft hole formed eccentrically with respect to a center of an outer circumference of the spherical bearing to receive the guide bar, and a position deciding member maintaining a position of the spherical bearing with respect to the carriage and aligning the carriage with regard to the guide bar.

The position deciding member includes a plurality of position deciding grooves formed at a side of the spherical bearing at an equal interval in a circular direction on the basis of a common center of an outer circumference of the spherical bearing, a flexible plate coupled to the carriage to flexibly hold the spherical bearing with respect to the carriage, and position deciding protrusions formed on the flexible plate to be flexibly inserted into and separated from the position deciding grooves.

Moreover, the flexible plate has a fixation body and a pair of flexible support portions extended from one end of the fixation body and bent toward the side of the spherical bearing to flexibly push the side of the spherical bearing, the pair of flexible support portions having the position deciding protrusions at both ends corresponding to the position deciding grooves.

In addition, it is preferable that a plurality of tool support elements are formed at the side of the spherical bearing, to increase a rotation force of the spherical bearing when a driving tool is inserted into the tool support elements to rotate the spherical bearing.

BRIEF DESCRIPTION OF THE DRAWINGS

These and other objects and advantageous of the invention will become apparent and more readily appreciated from the following description of the preferred embodiments, taken in conjunction with the accompanying drawings of which.

DESCRIPTION OF THE PREFERRED EMBODIMENT

Figure 1:
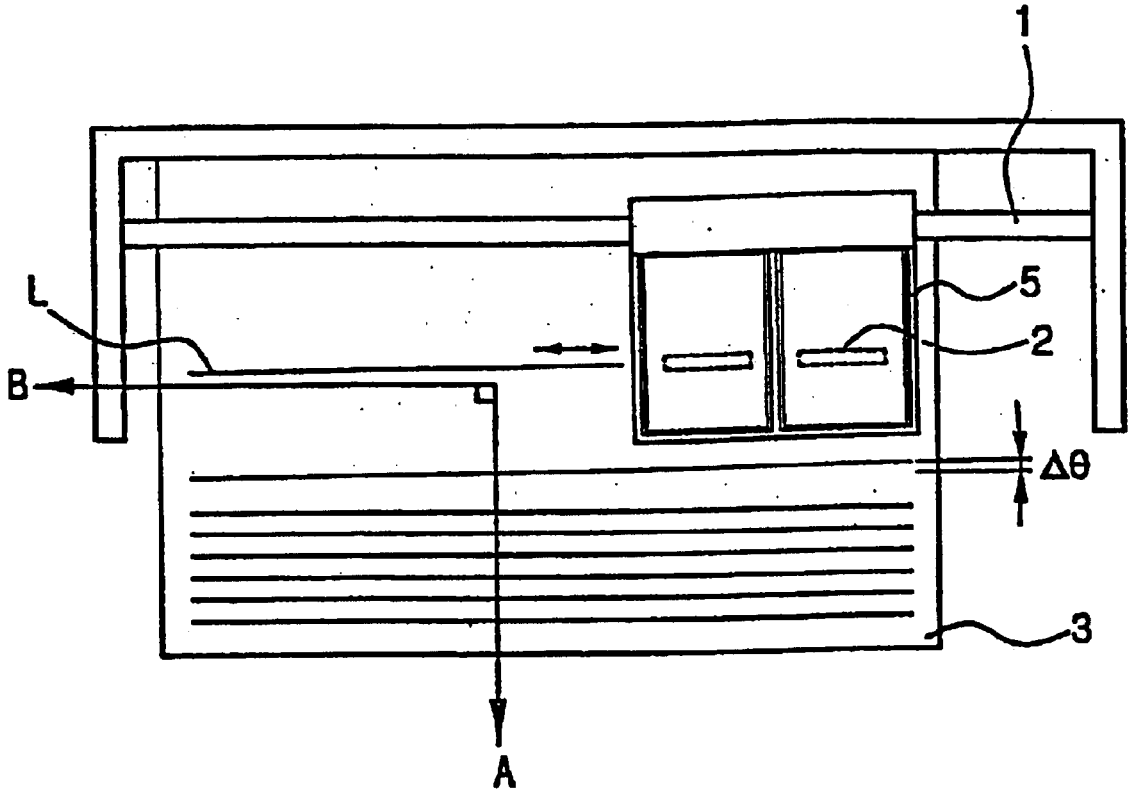
FIG. 1 PRIOR ART
FIG. 1 is a plan view schematically showing a conventional ink-jet printer.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Herein below, a carriage aligning apparatus for an ink-jet printer according to an embodiment of the present invention will be described in great detail by referring to the accompanying drawings.

Figure 2:
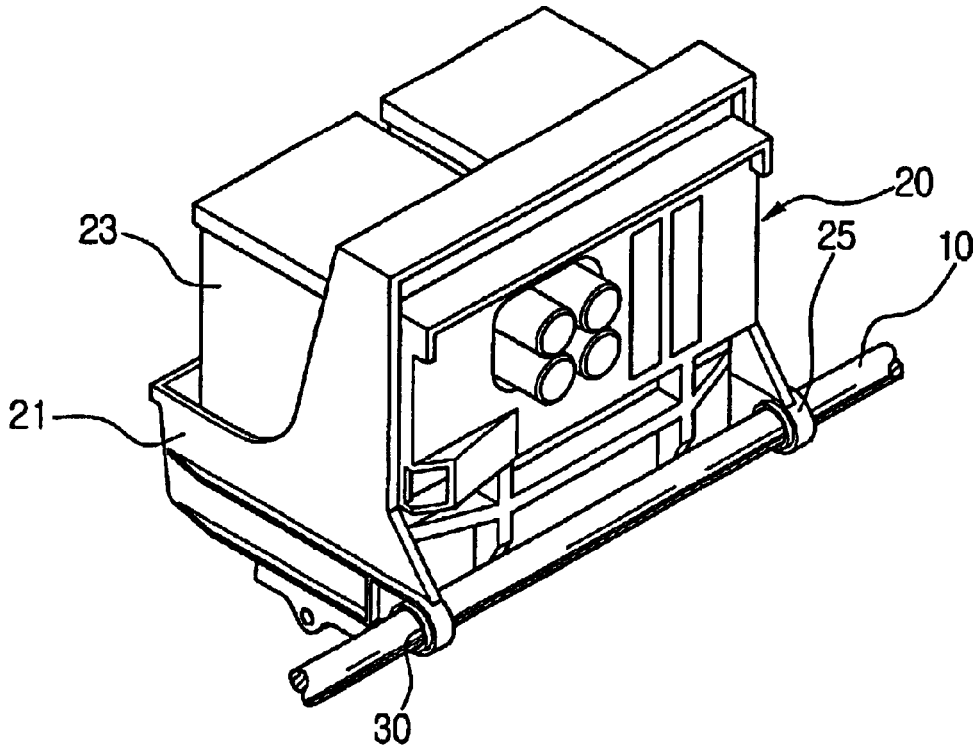
FIG. 2 is a perspective view schematically showing a carriage aligning apparatus for an ink-jet printer according to an embodiment of the present invention.

Referring to FIG. 2, the carriage aligning apparatus for the ink-jet printer has a carriage 20 movably disposed at a guide bar 10, a spherical bearing 30 disposed between the carriage 20 and the guide bar 10, and a position deciding member.

The guide bar 10 is disposed at a main frame (not shown) of the ink-jet printer. The guide bar 10 is disposed across a paper transferring direction at a right angle.

The carriage 20 is disposed at a lengthwise direction of the guide bar 10 in order to be reciprocally moved by a predetermined moving device. The carriage 20 has a carriage body 21 supported to the guide bar 10, and an ink cartridge 23 removably disposed at the carriage body 21. A pair of support portions 25, which are connected to and supported by the guide bar 10, are disposed at one lower end of the carriage body 21. An ink nozzle array is disposed at a lower end of the ink cartridge 23 in order to eject the ink on the paper.

Figure 3:
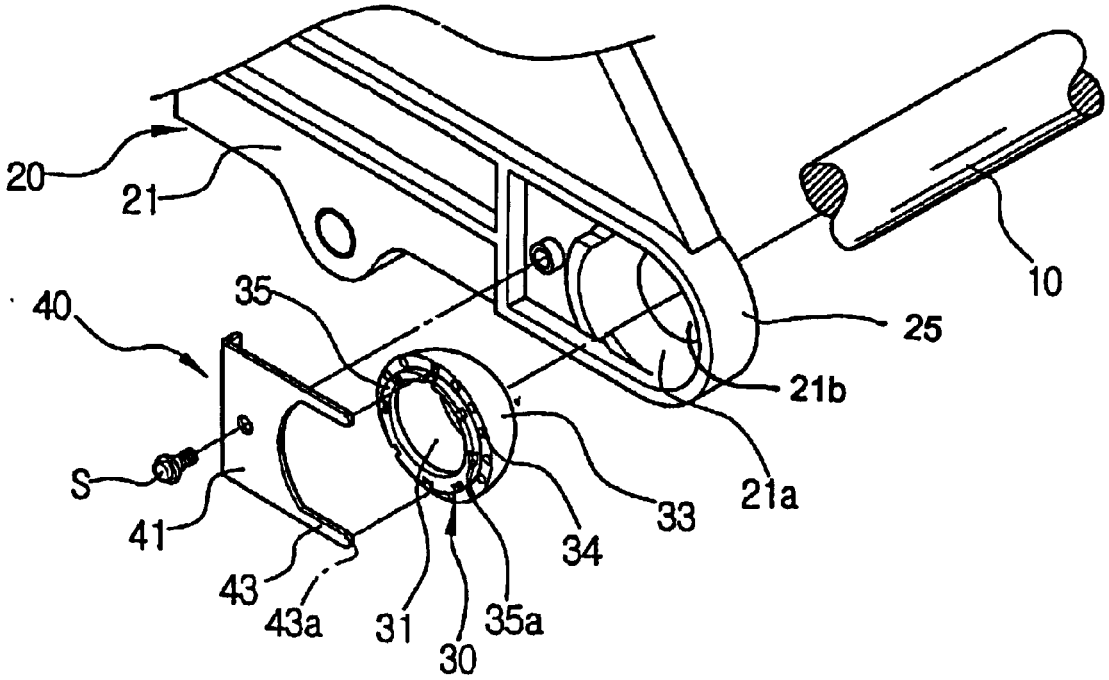
FIG. 3 is an exploded perspective view schematically showing a spherical bearing and a flexible plate of the carriage aligning apparatus of FIG. 2.
Figure 4:
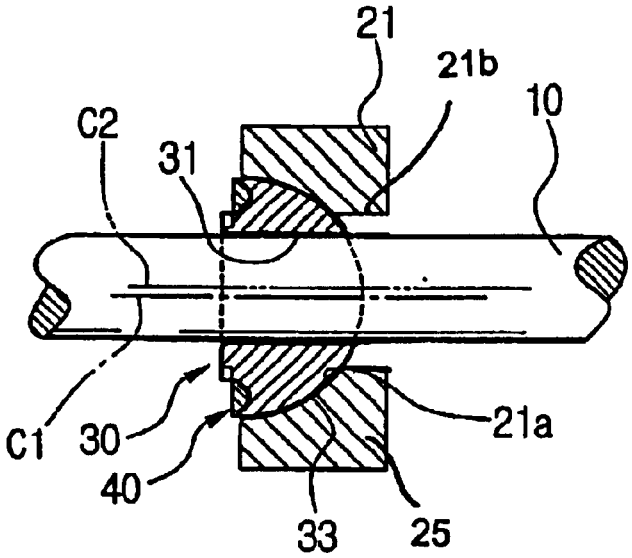
FIG. 4 is a partial cross-sectional view showing the spherical bearing and a support portion of the carriage aligning apparatus of FIG. 2.

As shown in FIG. 3, the spherical bearing 30 has a shaft hole 31 receiving the guide bar 10. Moreover, the spherical bearing 30 has a half (semi)-spherical bearing surface 33 at one side to correspond to a bearing connection portion 21*a* formed at the carriage body 21. As shown in FIG. 4, the bearing connection portion 21*a* has the half-spherical shape corresponding to the bearing surface 33 of the spherical bearing 30.

Figure 5:
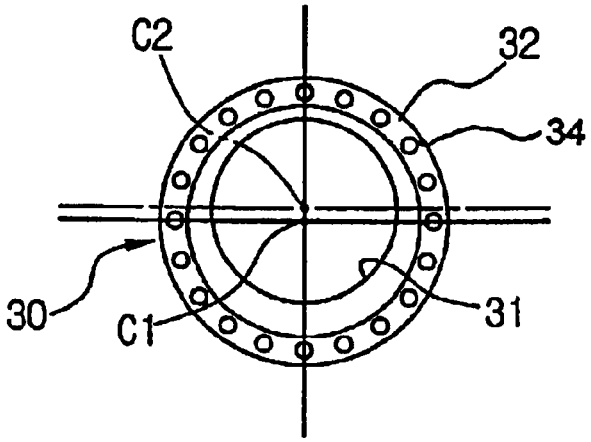
FIG. 5 is a front view showing the spherical bearing shown in FIG. 3.

As shown in FIG. 5, the shaft hole 31 of the spherical bearing 30 has a shaft center (axis) C2 eccentric to a common center (axis) C1 of an outer circumference 32 of the spherical bearing 30. In other words, the shaft hole 31 having the same shaft area as that of the guide bar 10 is formed to be eccentric with respect to the common center C1 of the outer circumference 32 of the spherical bearing 30 supporting the carriage 20. Therefore, a location of the carriage 20 can be changed by as much as an eccentric length of a position of the guide bar 10 with respect to the common center C1 according to a rotation position of the spherical bearing 30.

Furthermore, the spherical bearing 30 has a flange portion 35 protruding from the side of the spherical bearing 30 around the shaft hole 31. A plurality of tool support holes 35*a* are formed at the flange portion 35 at a predetermined interval. The spherical bearing 30 is easily rotated when a tool, such as a driver, is inserted into one of the tool support holes 35*a* to rotate the spherical bearing 30.

The position deciding member aligning the carriage 20 with respect to the guide bar 10 is provided to maintain a position of the spherical bearing 30 with regard to the carriage 20. As shown in FIG. 3, the position deciding member has a plurality of position deciding grooves 34 and a flexible plate 40 preventing the spherical bearing 30 from being separated and rotated by flexibly supporting the spherical bearing 30.

As shown in FIG. 5, the position deciding grooves 34 are formed in a circular arc on the basis of the common center C1 of the outer circumference 32 of the spherical bearing 30 at a predetermined interval. It is preferable that one interval between two adjacent position deciding grooves 34 is formed at a predetermined interval so as to adjust the guide bar 10 deviating from a predetermined reference center line by 1 $\mu$m.

The flexible plate 40 has a fixation body 41 coupled to the carriage 20, and a pair of flexible support portions 43 extended from one side of the fixation body 41 and bent to flexibly push the side of the spherical bearing 30 toward the bearing connecting portion 21*a* of the support portion 25. The fixation body 41 is coupled to the carriage body 21 by a screw S with a plate shape. The flexible support portions 43 serves as a plate spring flexibly supporting the spherical bearing 30. The flexible support portions 43 are disposed at a predetermined interval so as to allow the guide bar 10 to be placed therebetween. Therefore, the spherical bearing 30 is supported by the flexible support portions 43. Moreover, position deciding protrusions 43*a* corresponding to the position deciding grooves 34 are disposed at both ends of the flexible support portions 43. The position deciding protrusions 43*a* are formed at the flexible support portions 43 to have an embossing type, and are flexibly inserted into and separated from the position deciding grooves 34. Accordingly, when the position deciding protrusions 43*a* are inserted into and connected with the position deciding grooves 34, the spherical bearing 30 cannot freely rotate and the position of the spherical bearing 30 is fixed with respect to the guide bar 10 and the support portion 25 of the carriage 20. In addition, the spherical bearing 30 is flexibly supported in the bearing connection portion 21*a* by the flexible plate 40 and prevented from being separated.

A carriage aligning method using the carriage aligning apparatus for an ink-jet printer according to the embodiment of the present invention having the above structure will be described hereinbelow.

Figure 6:
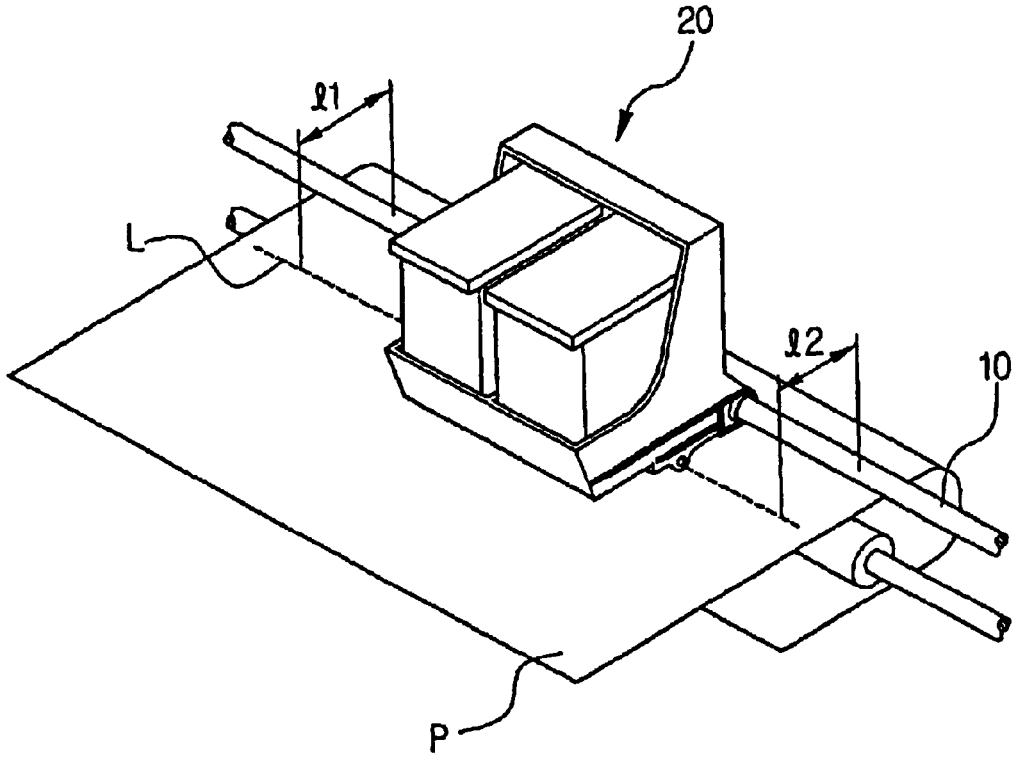
FIGS. 6 through 8 are views respectively explaining a carriage aligning operation of the carriage aligning apparatus of FIG. 2.

As shown in FIG. 6, when the paper passing below the carriage 20 is printed as the carriage 20 moves along the guide bar 10, the printing line L and the guide bar 10 might not be level with each other and deviated by a predetermined angle. In this case, it is supposed that the deviation of intervals /1 and /2 between both right and left sides of the guide bar 10 and the printing line L is 5 $\mu$m. When a printing operation is continuously proceeded in this state, an image is printed on the paper being skewed or oblique with respect to the paper transferring direction, and thus the quality of the image printed on the paper is downgraded.

Therefore, to overcome and avoid the deviation of the intervals /1 and /2, the spherical bearing 30 supporting the carriage 20 should be rotated by a predetermined angle.

Figure 7:
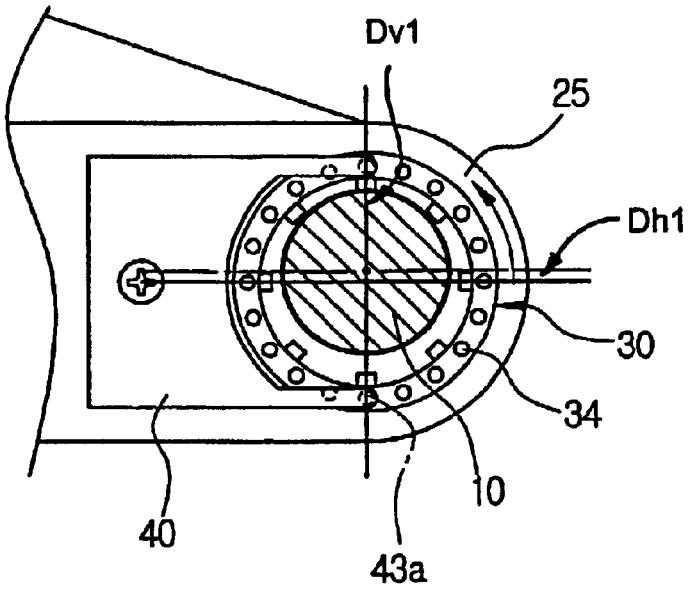

In other words, in the state as shown in FIG. 7, the driving tool (not shown) is inserted into the tool support holes 35*a* of the spherical bearing 30 and rotated in a direction of an arrow. Then, as the position deciding protrusions 43*a* of the flexible plate 40 flexibly come out from one of the position deciding grooves 34, the spherical bearing 30 is rotated. At this time, the spherical bearing 30 is designed to change the deviation by 1 $\mu$m as the spherical bearing 30 rotates by a basic angle corresponding to two adjacent position deciding grooves 34. The spherical bearing 30 is rotated by an interval corresponding to six position deciding grooves 34. Then, the spherical bearing 30 is rotated in the state shown in FIG. 8. As the spherical bearing 30 moves by the interval formed by the six position deciding grooves 34, the deviation of 5 $\mu$m is corrected. Moreover, the position deciding protrusions 43*a* are connected with the position deciding grooves 34 of the spherical bearing 30 again by an flexible restoring force of the flexible plate 40, and prevents the spherical bearing 30 from moving.

Figure 8:
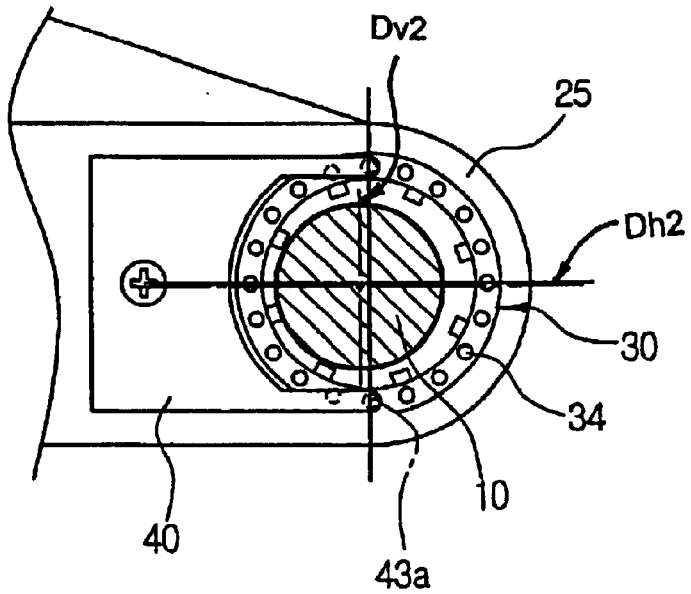

As described in FIGS. 7 and 8, a first vertical deviation DV1 and a first horizontal deviation DH1 between the common center C1 and the shaft center C2 are changed to a second vertical deviation DV2 and a second horizontal deviation DH2 of FIG. 8, respectively.

According to the carriage aligning apparatus for an ink-jet printer of the present invention described, misalignment generated due to a mechanical error of the carriage and the guide bar between the paper and the ink nozzle array can be adjusted. Accordingly, the image can be printed with a better resolution.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A carriage aligning apparatus in an ink-jet, printer including a guide bar and a carriage disposed to slide along the guide bar crossing a paper transferring direction, comprising:

a spherical bearing rotatably connected to the carriage, having a semi-spherical bearing surface at a side thereof which cooperates with a bearing connecting portion of the carriage, having a shaft hole formed eccentrically with respect to a common center of an outer circumference of the spherical bearing to rotatably receive the guide bar, and controlling the carriage to be aligned with the guide bar; and a position deciding member maintaining a position of the spherical bearing with respect to the carriage when the carriage is aligned with the guide bar in response to a movement of the spherical bearing.

2. The apparatus of claim 1, wherein the spherical bearing comprises a plurality of tool support elements at the side of the spherical bearing to increase a rotation force of the spherical bearing when an external tool is coupled to one of the tool support elements to rotate the spherical bearing.

3. A carriage aligning apparatus in an ink-jet printer including a guide bar and a carriage disposed to slide along the guide bar crossing a paper transferring direction, comprising:

a spherical bearing rotatably connected to the carriage, having a shaft hole formed eccentrically with respect to a common center of an outer circumference of the spherical bearing to rotatably receive the guide bar, and controlling the carriage to be aligned with the guide bar; and a position deciding member maintaining a position of the spherical bearing with respect to the carriage when the carriage is aligned with the guide bar in response to a movement of the spherical bearing, wherein the position deciding member comprises:

a plurality of position deciding grooves formed at a side of the spherical bearing at an equal interval on the basis of the common center of the outer circumference of the spherical bearing; and a flexible plate coupled to the carriage to flexibly push the spherical bearing toward the carriage, having position deciding protrusions flexibly inserted into and separated from corresponding ones of the position deciding grooves.

4. The apparatus of claim 3, wherein the flexible plate comprises:

a fixation body detachably coupled to the carriage; and a pair of flexible support portions extended from one end of the fixation body and bent so as to flexibly push the side of the spherical bearing toward the carriage, the pair of flexible support portions having the position deciding protrusions at both ends.

5. An apparatus in an ink-jet printer having a frame mounted with a mechanism transferring paper in a paper transferring direction, a guide bar fixedly mounted on the frame and disposed across the paper transferring direction, and a carriage mounted with a printing head and slidably coupled to the guide bar to move along the guide bar, comprising:

a carriage aligning unit disposed between the guide bar and the carriage to control the carriage to move toward and away from the guide bar, the carriage aligning unit including:

a spherical bearing rotatably connected to the carriage and having a semi-spherical bearing surface at a side thereof which cooperates with a bearing connecting portion of the carriage; and a position deciding member maintaining a position of the spherical bearing with respect to the carriage.

6. The apparatus of claim 5, wherein the carriage comprises a support having a connection hole, and the carriage aligning unit comprises a shaft hole, and the guide bar is inserted into the connection hole of the support and the shaft hole of the carriage aligning unit.

7. The apparatus of claim 6, wherein the shaft hole is eccentrically disposed with respect to the connection hole of the support.

8. The apparatus of claim 5, wherein the apparatus comprises an additional carriage aligning unit, and the carriage comprises a pair of supports each having a connection hole, each of the carriage aligning unit and the additional carriage aligning unit having a shaft hole, the carriage aligning unit and the additional carriage aligning unit disposed in corresponding connection holes of the supports and between the guide bar and corresponding supports of the carriage when the guide bar is inserted into both the connection holes of the supports and the shaft holes of the carriage aligning unit and the additional carriage aligning unit.

9. The apparatus of claim 5, wherein the carriage aligning unit comprises a shaft hole having a shaft axis eccentric to a common axis passing through a center of the carriage aligning unit, and the carriage comprises a connection hole having the common axis, the guide bar inserted into the shaft hole of the carriage aligning unit and the connection hole of the carriage.

10. The apparatus of claim 9, wherein the carriage moves with respect to the guide bar in response to a movement of the carriage aligning unit.

11. The apparatus of claim 9, wherein the carriage moves in a direction perpendicular to the guide bar in response to a movement of the carriage aligning unit.

12. The apparatus of claim 9, wherein the carriage aligning unit controls the carriage to move by a distance between the shaft axis and the common axis in response to a movement of the carriage aligning unit.

13. The apparatus of claim 12, wherein the connection hole of the carriage has a diameter greater than a sum of the distance and a diameter of the guide bar.

14. The apparatus of claim 12, wherein the connection hole is greater than the shaft hole, and the guide bar is disposed eccentrically within the connection hole while being disposed coaxially with the shaft hole.

15. The apparatus of claim 12, wherein the carriage moves from a non-parallel position to a parallel position parallel to the guide bar by the distance in response to the movement of the carriage aligning unit.

16. The apparatus of claim 5, wherein the carriage aligning unit comprises:

a bearing rotatably disposed between the carnage and the guide bar, having a shaft hole formed eccentrically with respect to a common axis of an outer circumference of the bearing to receive the guide bar, the carnage coupled to the guide bar through the bearing to move toward and away from the guide bar in response to a rotation of the bearing.

17. The apparatus of claim 16, wherein the carriage aligning unit comprises:

a position deciding member coupled between the bearing and the carriage to maintain the bearing in a position aligned with the guide bar in response to the rotation of the guide bar.

18. The apparatus of claim 16, wherein the bearing is a spherical bearing having a semi-spherical shape.

19. The apparatus of claim 18, wherein the carriage comprises a bearing connection portion corresponding to the semi-spherical shape of the spherical bearing to receive the spherical bearing.

20. The apparatus of claim 5, wherein the carriage aligning unit comprises:

a spherical bearing rotatably connected to the carriage and having a shaft hole formed eccentrically with respect to a common axis of an outer circumference of the spherical bearing to receive the guide bar; and a position deciding member holding the spherical bearing with respect to the carriage.

21. The apparatus of claim 20, wherein the spherical bearing comprises a plurality of grooves formed around the shaft hole of the spherical bearing, and the position deciding member is coupled to at least one of the grooves.

22. The apparatus of claim 21, wherein the position deciding member is released from the one of the grooves and coupled to another one of the grooves when the spherical bearing rotates about the common axis.

23. The apparatus of claim 21, wherein the second end is embossed to be coupled to the one of the grooves.

24. The apparatus of claim 21, wherein the spherical bearing does not rotate with respect to the carriage and the guide bar when the position deciding member is coupled to the one of the grooves.

25. The apparatus of claim 21, wherein the position deciding member holds the spherical bearing to maintain a distance between the shaft center and the common axis when the position deciding member is coupled to the one of the grooves.

26. An apparatus in an ink-jet printer having a frame mounted with a mechanism transferring paper in a paper transferring direction, a guide bar fixedly mounted on the frame and disposed across the paper transferring direction, and a carriage mounted with a printing head and slidably coupled to the guide bar to move along the guide bar, comprising:

a carriage aligning unit disposed between the guide bar and the carriage to control the carriage to move toward and away from the guide bar wherein the carriage aligning unit comprises:

a spherical bearing rotatably connected to the carriage and having a shaft hole formed eccentrically with respect to a common axis of an outer circumference of the spherical bearing to receive the guide bar; and a position deciding member holding the spherical bearing with respect to the carriage, and wherein the carriage moves with respect to the guide bar by approximately 1 $\mu$m corresponding to a rotation of the spherical bearing by an interval between adjacent grooves.

27. An apparatus in an ink-jet printer having a frame mounted with a mechanism transferring paper in a paper transferring direction, a guide bar fixedly mounted on the frame and disposed across the paper transferring direction, and a carriage mounted with a printing head and slidably coupled to the guide bar to move along the guide bar, comprising:

a carriage aligning unit disposed between the guide bar and the carriage to control the carriage to move toward and away from the guide bar;

wherein the carriage aligning unit comprises:

a spherical bearing rotatably connected to the carriage and having a shaft hole formed eccentrically with respect to a common axis of an outer circumference of the spherical bearing to receive the guide bar; and a position deciding member holding the spherical bearing with respect to the carriage, and wherein the position deciding member is a flexible plate and comprises a first end coupled to the carriage and a second end extended from the first end to be coupled to the one of the grooves.

28. The apparatus of claim 27, wherein the second end of the position deciding member comprises a protrusion protruding toward the one of the grooves.

29. An apparatus in an ink-jet printer having a frame mounted with a mechanism transferring paper in a paper transferring direction, a guide bar fixedly mounted on the frame and disposed across the paper transferring direction, and a carriage mounted with a printing head and slidably coupled to the guide bar to move along the guide bar, the apparatus comprising:

a support formed on the carriage, having a common axis, a bearing connection portion, and a connection hole having the common axis and formed in the bearing connection portion to receive the guide bar;

a bearing having a first side corresponding to the bearing connection portion, a second side, a shaft hole formed between the first side and the second side to communicate with the connection hole and having a shaft axis eccentric to the common axis by a predetermined distance to receive the guide bar, and a plurality of grooves formed on the second side around the common axis; and a position holding member detachably mounted on the carriage to be coupled to one of the grooves when the bearing is disposed within the bearing connection portion.

30. The apparatus of claim 29, wherein the bearing controls the carriage to move with respect to the guide bar by varying a distance between the common axis and the shaft axis in response to a movement of the bearing.

31. The apparatus of claim 29, wherein the carriage moves by approximately 1 $\mu$m when the bearing moves by an interval between adjacent grooves about the common axis.

32. The apparatus of claim 29, wherein the grooves are formed in a circular direction of the common axis.

33. The apparatus of claim 29, wherein the position holding member comprises a body coupled to the carriage and two extensions extended from the body and disposed opposite sides of the guide bar to be coupled to corresponding ones of the grooves.

34. The apparatus of claim 29, wherein the first side of the bearing faces the connection portion, and the second side of the bearing faces the position holding member.

35. The apparatus of claim 29, wherein the bearing comprises at least one tool supporting element formed on the second side around the common axis, and an external tool is coupled to the tool supporting element to rotate the bearing about the common axis.

36. The apparatus of claim 29, wherein the position holding member is biased to push the bearing toward the connection portion of the support.

37. A method in an inkjet printer having a guide bar, a carriage moving along the guide bar, a bearing coupled between the guide bar and carriage to move the carriage with respect to the guide bar and having a semi-spherical bearing surface at a side thereof which cooperates with a bearing connecting portion of the carriage, and an eccentric hole formed in the bearing about a shaft axis eccentric to a common axis passing a center of the bearing to receive the guide bar disposed eccentric to the common axis, the method comprising:

rotating the bearing about the common axis; and moving the carriage toward and away from the guide bar in response to a rotation of the bearing.

38. The method of claim 37, wherein the moving of the carriage comprises changing a distance between the common axis and the shaft axis in response to a movement of the carriage with respect to the guide bar.

* * * * *